US005906522A

United States Patent [19]

Hooper

[11] Patent Number: 5,906,522

[45] Date of Patent: May 25, 1999

[54] THRUST ENHANCER FOR MARINE PROPELLER

[76] Inventor: Robert P. Hooper, 633½ Rockledge Dr., Rockledge, Fla. 32955

[21] Appl. No.: 09/053,313

[22] Filed: Apr. 1, 1998

[51] Int. Cl.[6] ..... B63H 1/16

[52] U.S. Cl. ..... 440/66; 416/247 A

[58] Field of Search ..... 440/66, 67, 71–73; 416/247 A

[56] References Cited

U.S. PATENT DOCUMENTS

| | | | |
|---|---|---|---|
| 4,106,425 | 8/1978 | Gruber | 440/72 |
| 4,637,801 | 1/1987 | Schultz | 440/67 |
| 5,176,550 | 1/1993 | Hooper | 440/72 |

*Primary Examiner*—Jesus D. Sotelo

*Attorney, Agent, or Firm*—Larson & Larson, P.A.; James E. Larson

[57] ABSTRACT

A thrust enhancer includes a peripheral ring with an exhaust ring concentrically supported within the peripheral ring by a plurality of radially extending circumferentially spaced struts. Each strut carries a blade that is preferably angled in the left-hand direction at about a 36° angle with respect to a plane defined by the strut to redirect water flowing at lateral angles with respect to the axis of the propeller shaft so that the water moves more in alignment with the propeller shaft to cause the thrust forces caused by rotation of the propeller to be directed more completely aligned with the axis of the propeller shaft. Suitable brackets are provided for securely mounting the thrust enhancer onto an outboard motor housing or other mounting location aft of a marine propulsion propeller.

18 Claims, 8 Drawing Sheets

THRUST ENHANCER FOR MARINE PROPELLER

BACKGROUND OF THE INVENTION

The present invention relates to a thrust enhancer for marine propeller. Applicant herein is also the patentee of U.S. Pat. No. 5,176,550 issued Jan. 5, 1993, for ENGINE PROPELLER BLADE AND LOWER UNIT PROTECTOR. FIGS. 1, 2 and 3 herein directly correspond to FIGS. 1, 6 and 7, respectively, of Applicant's prior U.S. Pat. No. 5,176,550, the specification of which is hereby incorporated by reference, in its entirety. The invention disclosed in U.S. Pat. No. 5,176,550, in its several embodiments, is intended to protect the propeller blade and lower unit of a marine outboard motor, not only to protect these structures from being damaged but, also, to protect Manatees and other marine creatures from propeller damage.

In a preferred embodiment of the present invention, the inventive thrust enhancer is designed to be coupled to a protector similar to that which is illustrated in FIGS. 2 and 3 herein. If desired, the inventive thrust enhancer may be mounted directly to the outboard motor housing or other vessel skeg in the absence of a lower unit protector.

In marine propulsion devices, the predominant means of providing thrust comprises a propeller having two or more blades. As the propeller spins, water is forced backward, resulting in forward thrust of the propeller, and the vessel attached thereto via a propeller shaft.

However, as is known, the thrust produced by a marine propeller is not directed solely in the rearward direction. Lateral components of the force generated by the propeller exist that rob the propulsion system of optimal efficiency. If a means could be devised to cause the propulsive force of a marine propeller to be directed most optimally in a single rearward direction, efficiency would be enhanced dramatically. It is with this need in mind that the present invention was developed.

SUMMARY OF THE INVENTION

The present invention relates to a thrust enhancer for marine propeller. The present invention includes the following interrelated objects, aspects and features:

(1) In a first aspect, the engine propeller blade and lower unit protector depicted in the figures of this application has been slightly modified from its structure as disclosed in Applicant's prior U.S. Pat. No. 5,176,550. In particular, with reference to FIG. 3 herein (corresponding to FIG. 7 of Applicant's prior patent), the ring shaped member 30A is generally circular except for the straight portion 32A that comprises two short, straight segments fastened to either side of the top member 14A and, together, comprise a chord of the circle defined, in part, by the ring shaped member 30A. In the engine propeller blade and lower unit protector described herein, instead of the use of segments 32A defining a chord of the circle defined by the ring shaped member 30A, two diagonal sections extend upwardly symmetrically from the circle partially defined by the ring shaped member and are interconnected by a horizontal strap connected to either side of a top member.

(2) The inventive thrust enhancer preferably includes a peripheral ring having the same diameter as the ring shaped member of the lower unit protector to which it is preferably affixed. In this way, the thrust enhancer and the ring shaped member form a continuous cylindrical passageway for water moved by the propeller.

(3) An exhaust ring of much smaller diameter than the peripheral ring is concentrically supported within the peripheral ring by a plurality of radially extending circumferentially spaced struts, each of which extends from the outer periphery of the exhaust ring to an inner surface of the peripheral ring. Each strut has a generally flat rectangular cubic configuration with the smallest profile thereof aligned parallel with the direction of thrust of the propeller. In this way, the struts provide the least resistance to water flow around them as the propeller turns.

(4) Each strut carries a blade that is preferably angled in the left-hand direction at about a 36° angle with respect to a plane defined by the strut. This angled relationship is intended to redirect water flowing at lateral angles with respect to the axis of the propeller shaft so that the water moves more in alignment with the propeller shaft to cause the thrust forces caused by rotation of the propeller to be directed more completely aligned with the axis of the propeller shaft or in parallel alignment therewith.

(5) The peripheral ring includes a part cylindrical segment of greater thickness in the fore-aft direction than the remainder of the ring and located at the top thereof at a location in alignment with the portion of the strap for the engine propeller blade and lower unit protector described above as including two diagonal legs and a horizontal connecting segment. When the peripheral ring is assembled in abutting relationship to the strap of the engine propeller blade and lower unit protector, the thicker segment extends into the strap to combine the ring with the strap to create a cylindrical structure that channels water flowing from the propeller therethrough and through the rest of the peripheral ring and then beyond in the rearward direction. Without this thickened segment, water flowing from the propeller has an escape route above the strap and peripheral ring through the opening formed by the diagonal portions of the strap and the horizontal segments thereof that would prevent maximum efficiency of the structure of the thrust enhancer.

(6) As will be described in greater detail hereinafter, suitable brackets are provided for securely mounting the inventive thrust enhancer onto an outboard motor housing and, if desired, onto an existing installed lower unit protector.

As such, it is a first object of the present invention to provide a thrust enhancer for marine propeller.

It is a further object of the present invention to provide such a device that may be removably affixed to an existing engine propeller blade and lower unit protector.

It is a still further object of the present invention to provide such a device that redirects flow of water from a marine propeller so that the water flows more in alignment with the axis of the propeller shaft.

It is a yet further object of the present invention to provide such a device including blades mounted on radially extending struts, which blades redirect water flow.

These and other objects, aspects and features of the present invention will better understood from the following detailed description of the preferred embodiment when read in conjunction with the appended drawing figures.

SPECIFIC DESCRIPTION OF THE PREFERRED EMBODIMENTS

Figure 1:
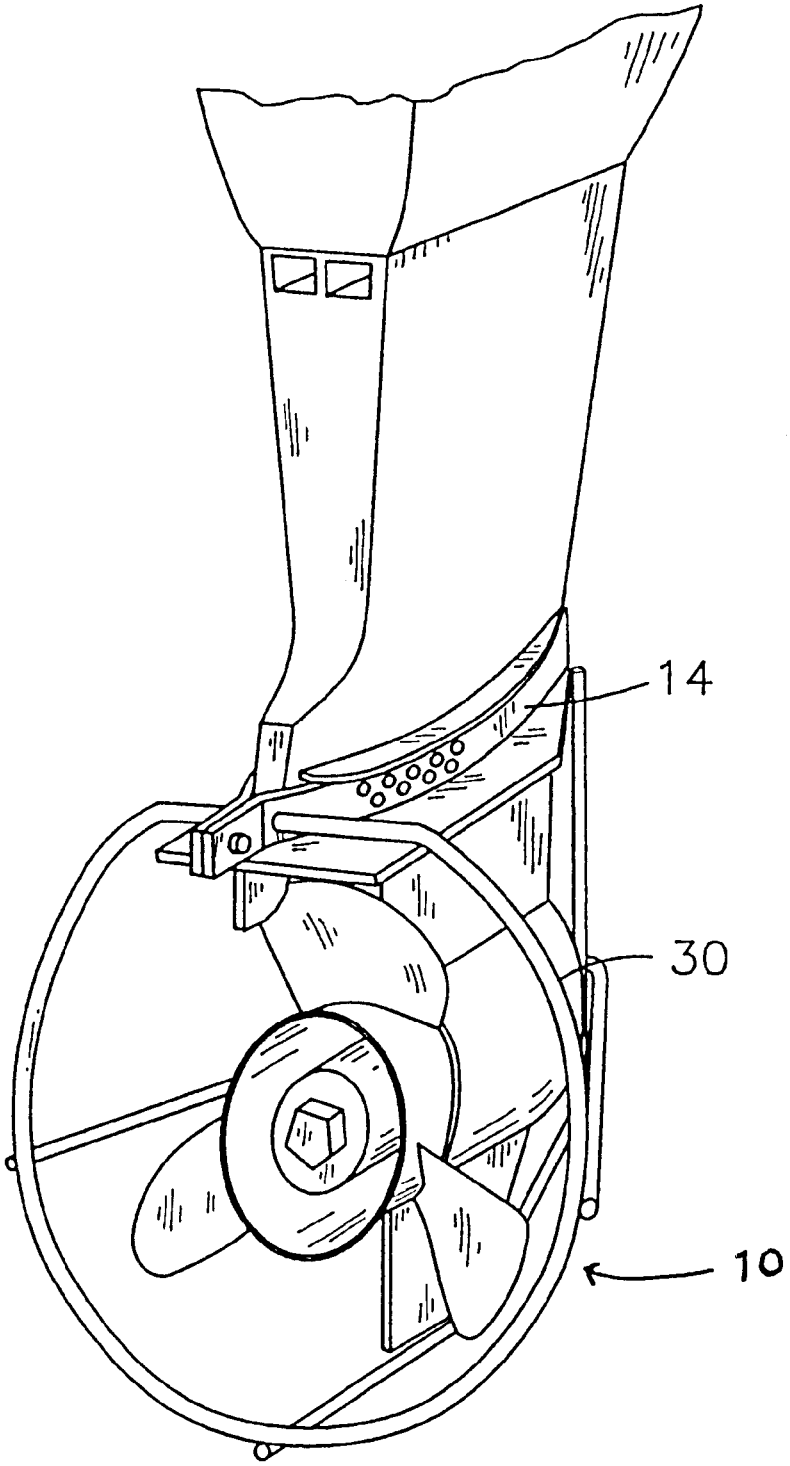
Fig. 1 PRIOR ART
FIGS. 1, 2 and 3 correspond to FIGS. 1, 6 and 7, respectively, of Applicant's prior U.S. Pat. No. 5,176,550 and depict a prior art engine propeller blade and lower unit protector.
Figure 2:
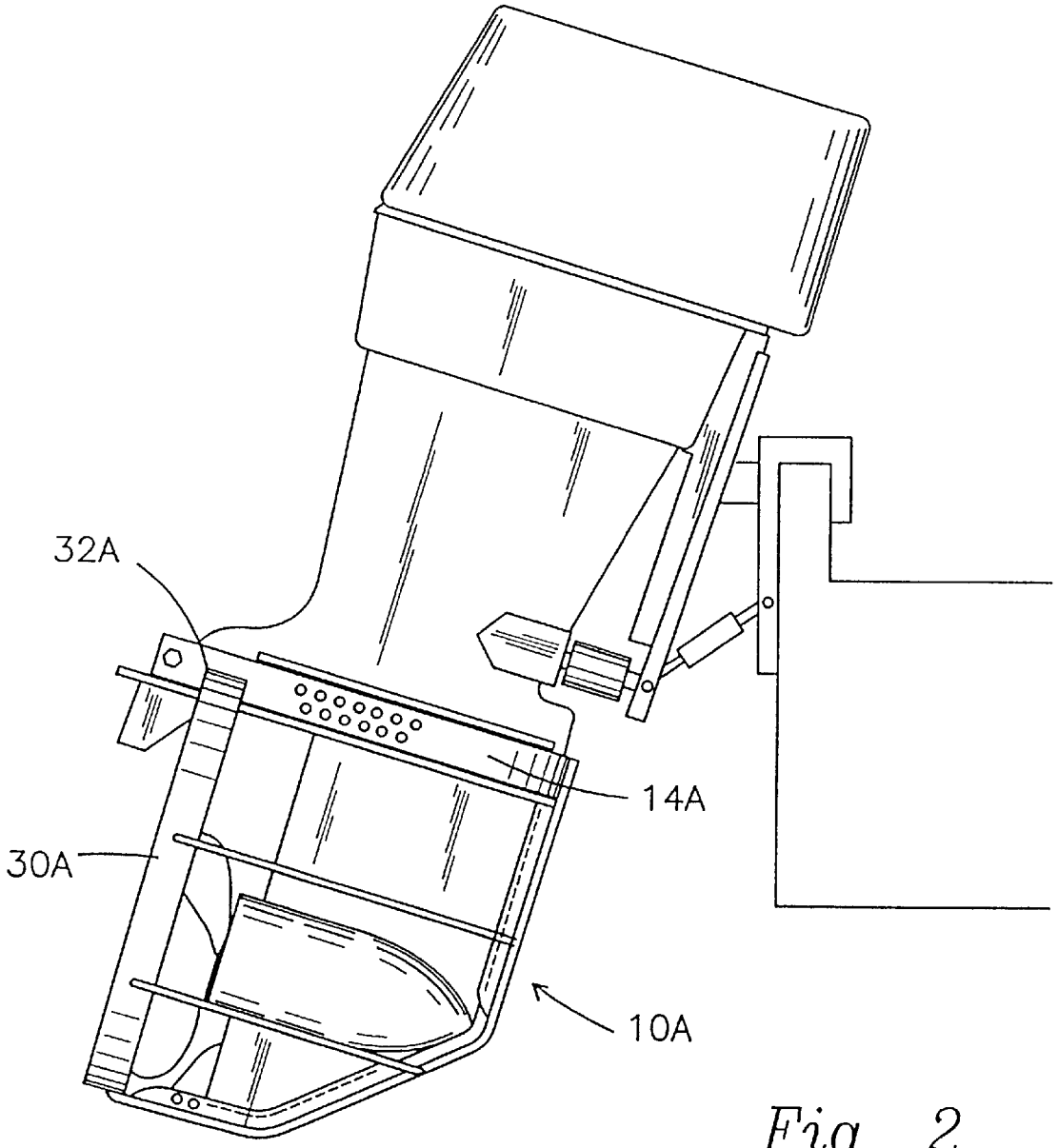
Fig. 2 PRIOR ART
Figure 3:
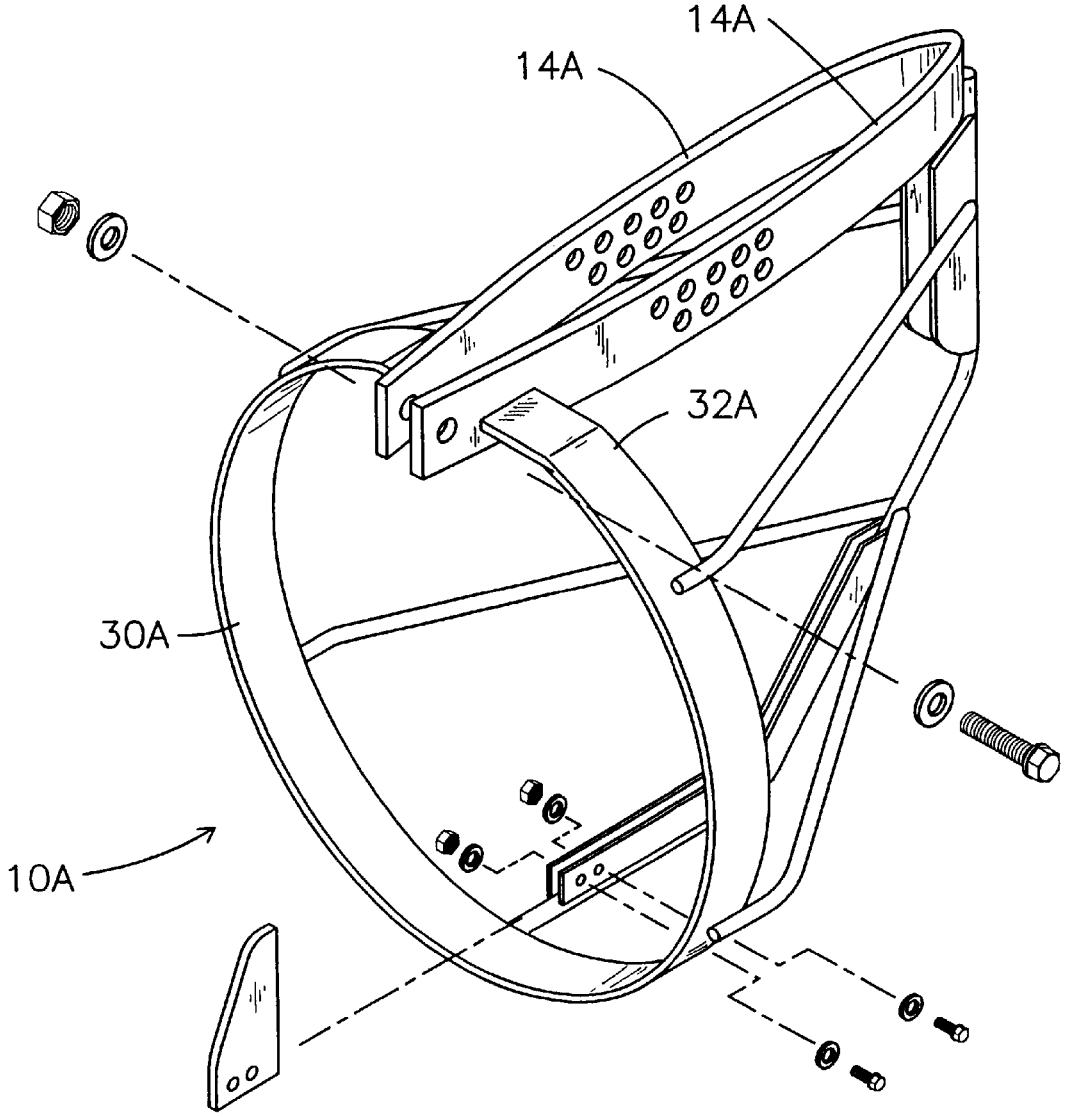
Fig. 3 PRIOR ART
Figure 4:
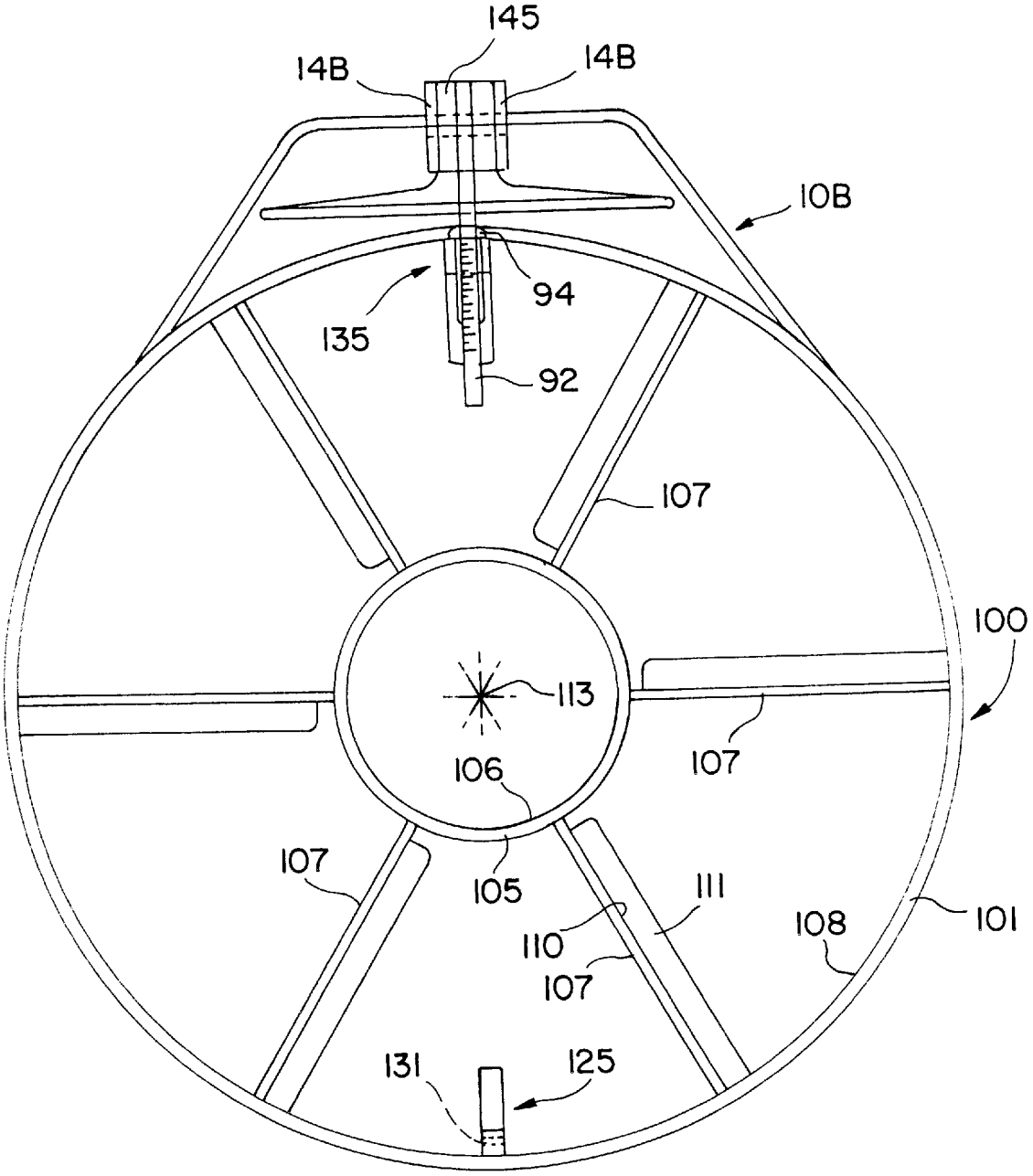
FIG. 4 shows a rear view of the thrust enhancer in accordance with the teachings of the present invention as coupled to a lower unit protector.
Figure 5:
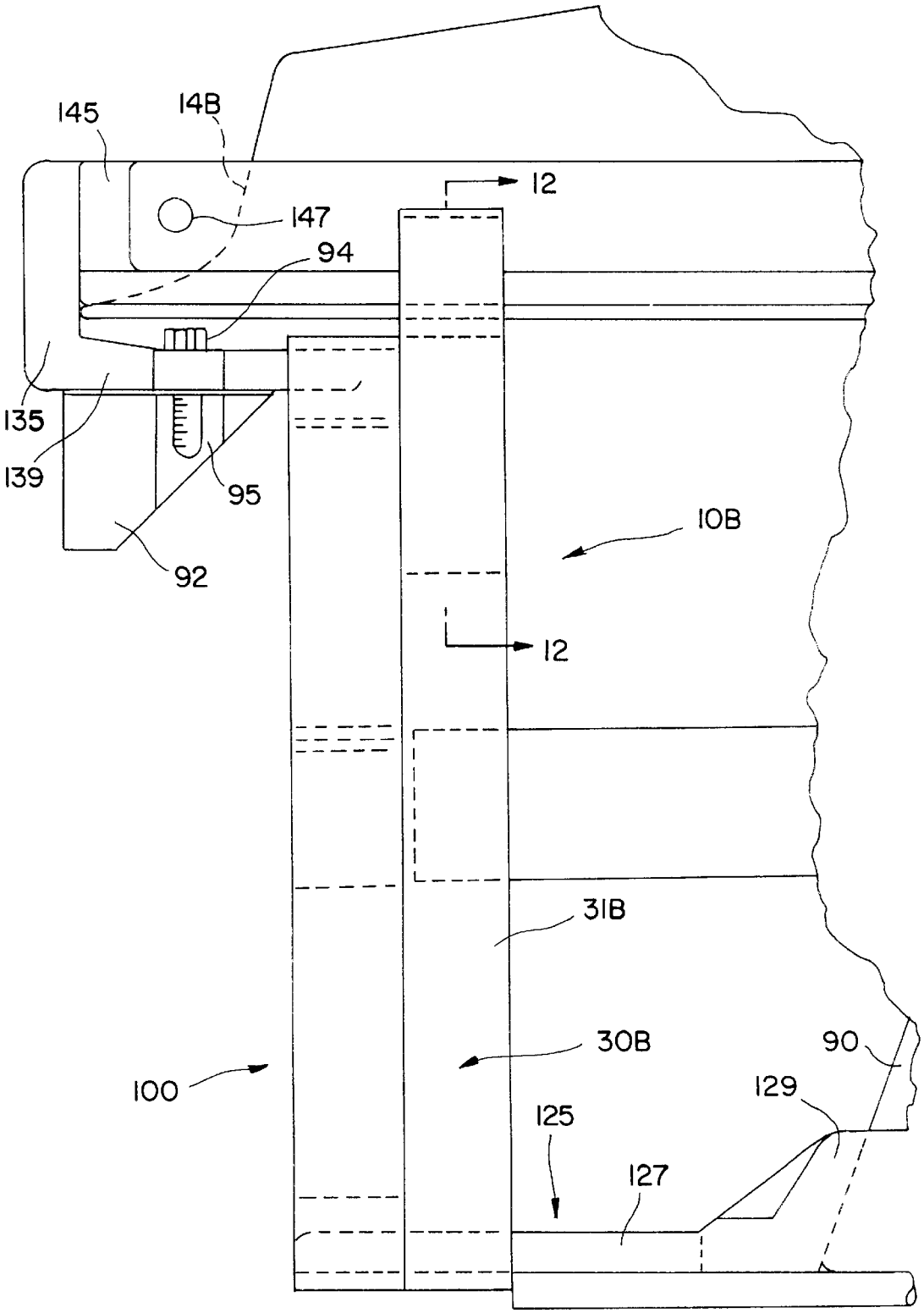
FIG. 5 shows a side view of the structure shown in FIG. 4 with further details of an associated outboard motor being depicted.
Figure 6:
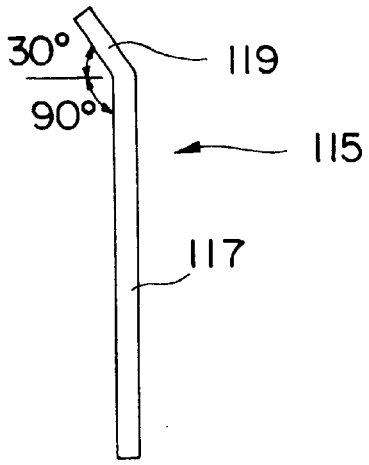
FIG. 6 shows a blade angle gauge depicting the angular relationship between each strut and its respective blade.
Figure 7:
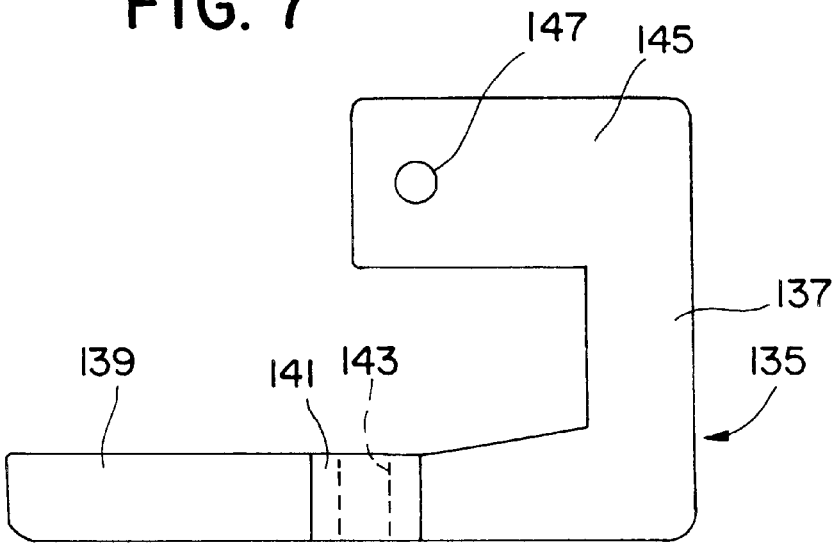
FIG. 7 shows a side view of an upper mounting bracket of the present invention.
Figure 8:
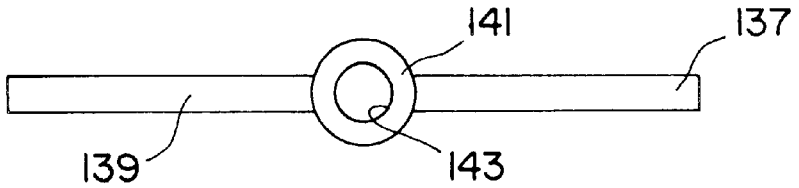
FIG. 8 shows a bottom view of the bracket of FIG. 7.

With reference, first, to FIGS. 4 and 5, the lower unit protector 10B is similar to that which is illustrated in 10A in FIGS. 6, 7 and 8, of Applicant's prior U.S. Pat. No. 5,176,550 (with FIGS. 6 and 7 thereof corresponding to FIGS. 2 and 3 herein). The main difference therebetween consists of a slight structural modification to the ring shaped member 30 of FIG. 1 and 30A in FIGS. 2 and 3 of U.S. Pat. No. 5,176,550. Ring shaped member 30B includes a generally circular portion 31B (FIGS. 5 and 12) merging into two symmetrically opposed straight leg portions 33B that extend diagonally in a direction of convergence and are interconnected by short horizontal segments 35B, each of which is fastened to opposed sides of a top member 14B which corresponds to 14 in FIG. 1 and 14A in FIG. 2. The interconnection between the horizontal segments 35B and the top member 14B generally corresponds to the interconnection between the horizontal segments 32A and the top member 14A as illustrated in FIGS. 2 and 3 and top member 14 in the propeller guard 10 shown in FIG. 1.

Figure 12:
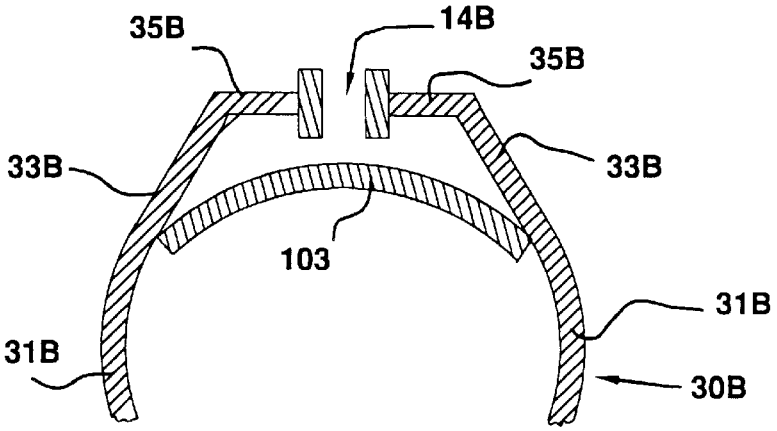
FIG. 12 shows a cross-sectional view along the line 12—12 of FIG. 5.
Figure 13:
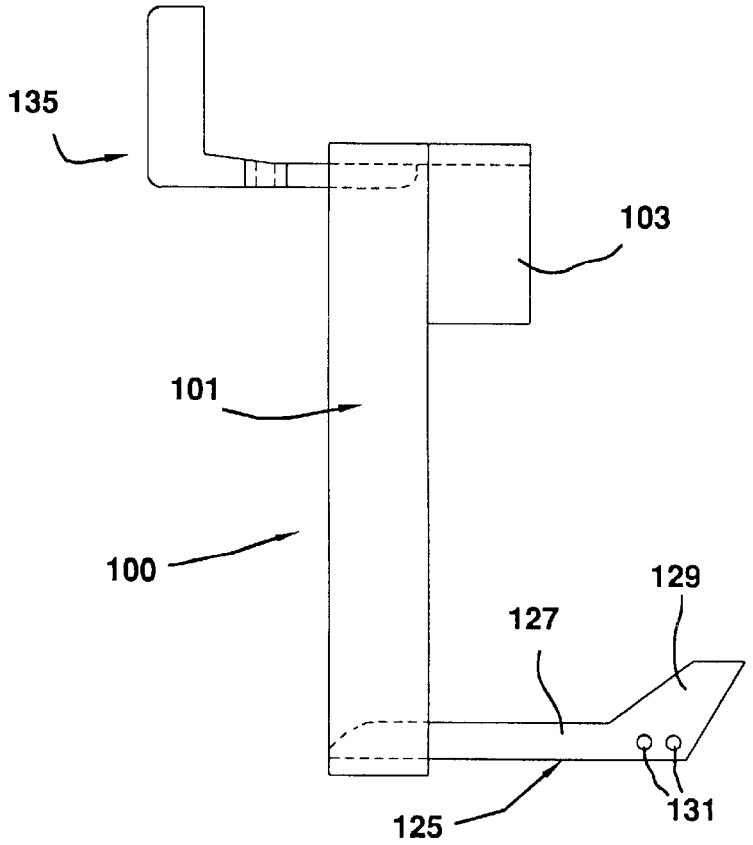
FIG. 13 shows a side view of the inventive thrust enhancer.

With reference, now, to FIGS. 4, 5, 12 and 13, in particular, the inventive thrust enhancer is generally designated by the reference numeral 100 and includes a generally cylindrical thruster ring or peripheral ring 101. With reference to FIG. 13, the ring 101 includes a segment 103 at a top region thereof extending part of the way about the circumference thereof, and of greater length in the fore-aft direction than the rest of the ring 101, for a purpose to be described in greater detail hereinafter. Generally, the segment 103 is the same width as the width of the ring shaped member 30 of the propeller guard.

Figure 10:
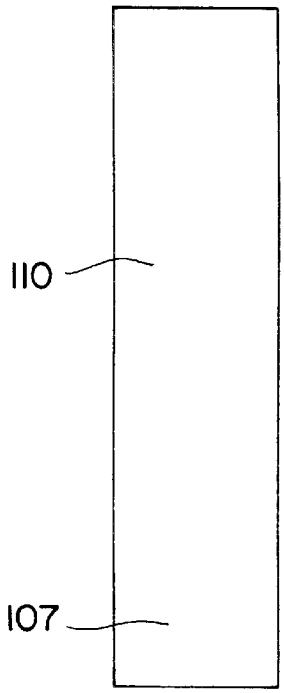
FIG. 10 shows a side view of a blade strut.
Figure 9:
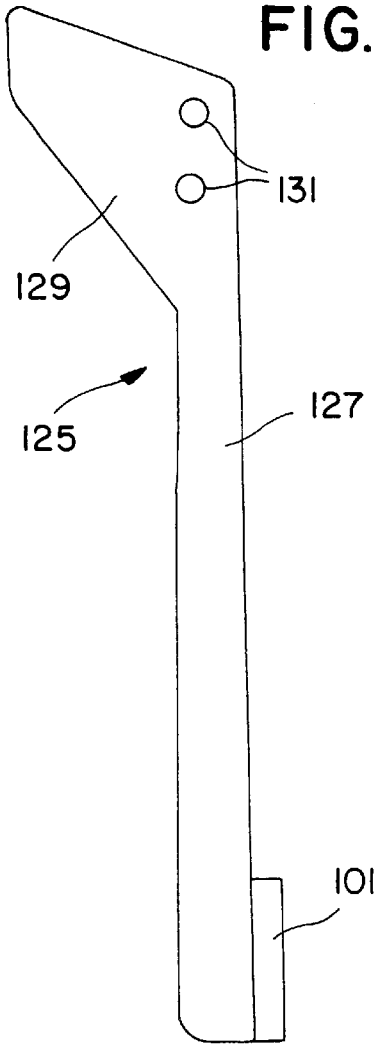
FIG. 9 shows a side view of a lower mounting bracket of the present invention.

With particular reference to FIG. 4, an exhaust ring 105 is concentrically disposed within the peripheral ring 101 and is suspended in that orientation by a plurality of radially extending circumferentially spaced struts 107. Each strut 107 (FIG. 10) has a radially inward end affixed to an outer periphery of the exhaust ring 105 and a radially outward end affixed at an inner surface 108 of the peripheral ring 101. The interconnection between each strut and the rings 101 and 105 may be by any suitable method such as, for example, welding. The exhaust ring 105 includes a central opening 106.

With further reference to FIG. 4, each strut 107 has a short dimension comprising the thickness of the strut that is directed in alignment with the axis 113 of the propeller shaft of the propeller of the associated propulsion means, whether an inboard motor, an inboard/outboard motor with an outdrive, or an outboard motor.

Figure 11:
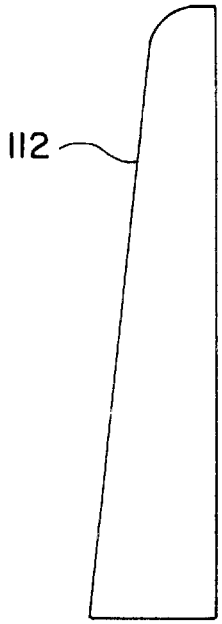
FIG. 11 shows a side view of a blade.

With further reference to FIG. 4, each strut 107 has affixed thereto a blade 111 that is elongated, radially, and extends a substantial distance between the exhaust ring 105 and the peripheral ring 101. In the preferred embodiment in a clockwise turning propeller, each blade 111 (FIG. 11) extends in the counterclockwise direction with respect to the strut 107 when looking at the inventive device 100 in the forward direction from aft thereof This direction is preferably opposite to the direction of rotation of the propeller, and the purpose for the blades 111 is to redirect thrust comprising water flowing rearward of the propeller in a direction more in alignment with the axis 113 of the propeller shaft. As seen in FIG. 11, each blade 111 has an edge 112 that tapers from a thicker dimension adjacent the peripheral ring 101 to a smaller dimension adjacent the exhaust ring 105.

In the preferred embodiment of the present invention, each strut 107 and its attached blade 111 make an angle therebetween of 26° to 36° from a line perpendicular to a side wall 110 of each strut 107.

FIG. 6 shows a blade angle gauge 115 having legs 117 and 119 with the leg 117 corresponding to the strut 107 and with the leg 119 corresponding to the blade 111 and with the angular relationship being depicted in the figure.

With reference to FIGS. 4, 5, 6, 9 and 13, a lower mounting bracket 125 is mounted on the inner surface 108 of the ring 101 and includes a relatively thin elongated leg portion 127 connected with a generally trapezoidal portion 129 having holes 131 therethrough that allow fastening of the trapezoidal portion 129 to, for example, the skeg of the associated propulsion means. The skeg is designated by the reference numeral 90 in FIG. 5.

With reference to FIGS. 4, 5, 7, 8 and 13, an upper mounting bracket is generally designated by the reference numeral 135 and is generally L-shaped in configuration including a shorter leg 137 and a longer leg 139 with the longer leg 139 having a widened generally cylindrical hub portion 141 with an opening 143 therethrough (FIGS. 7 and 8) for a purpose to be described in greater detail hereinafter. As seen in particular in FIGS. 5 and 7, a spacer block 145 is affixed to the shorter leg 137 of the bracket 135 and has an opening 147 therethrough allowing mounting of the upper bracket, via the spacer, to the top members 14B (FIGS. 4, 5 and 12). As particularly seen in FIGS. 4 and 5, a trim tab 92 is mounted just aft of the peripheral ring 101 by a threaded bolt 94 extending through the opening 143 in the leg 139 of the bracket 135 and threadably received within a threaded opening 95 in the trim tab 92.

As should now be understood, from the above description, the inventive thrust enhancer 100 may be easily mounted to the lower unit protector 10B by inserting the thickened segment 103 into the ring shaped member 30B in the manner shown in FIG. 12, aligning the lower bracket 125 and the upper bracket 135 in the manner shown in particular in FIG. 5 and using suitable fastening means such as bolts to rigidly fasten the thrust enhancer 100 in place. The combination of the thickened segment 103 and the ring shaped member 30B allows smooth flow of water from the propeller through the ring shaped member 30B and ring 101 and beyond in the rearward direction with the blades 111 redirecting flow of water from the propeller more in alignment with the longitudinal axis 113 of the propeller.

If desired, brackets (not shown) may be provided to facilitate direct attachment of the thrust enhancer 100 to a location on a vessel just rearward of the propeller thereof without the need for attachment to a lower unit protector. This is the case whether the propeller is attached to an inboard motor via a propulsion shaft, to a lower unit of an inboard/outboard propulsion means, or to the lower unit of an outboard motor.

If desired, the struts 107 may be affixed between the exhaust ring 105 and the peripheral ring 101 in an orientation other than the radial orientation shown. Thus, for example, the struts 107 may be attached tangentially to the outer periphery of the exhaust ring 105 extending to points of attachment on the inner surface 108 of the peripheral ring 101.

Additionally, the 36° angle between a line perpendicular to the side wall 110 of a strut 107 and the blade 111, namely, 36°, has been chosen through experimentation conducted by Applicant. Of course, if desired, other angular relationships may be employed based upon the particular situation. Thus, a thrust enhancer spaced further from the propeller or nearer to the propeller might require a different angular relationship.

Accordingly, an invention has been disclosed in terms of a preferred embodiment thereof which fulfills each and every one of the objects of the invention as set forth hereinabove and provides a new and useful thrust enhancer for marine propeller of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. A thrust enhancer for a marine propulsion system having a propeller mounted on a shaft having an axis of rotation, said thrust enhancer comprising:

a) a generally cylindrical ring including mounting means for mounting said ring on a marine vessel just aft of said propeller and aligned with said axis of rotation;

b) three to six struts equally spaced about the cylindrical ring extending radially inwardly within the cylindrical ring to an exhaust ring concentrically located within said cylindrical ring, said struts spaced about a circumference of said cylindrical ring and exhaust ring; and c) each strut having a forward edge integral with a blade, the blade extending in a direction opposite to a direction of rotation of said propeller.

2. The thrust enhancer of claim 1, wherein each blade defines an angle of about 26° to 36 ° with respect to each respective strut.

3. The thrust enhancer of claim 2, wherein each blade is tapered from a wider dimension adjacent said cylindrical ring to a narrower dimension toward the exhaust ring.

4. The thrust enhancer of claim 1, wherein said mounting means includes a lower bracket attachable to a skeg of said vessel.

5. The thrust enhancer of claim 4, wherein said mounting means includes an upper bracket attachable below a cavitation plate of said vessel.

6. The thrust enhancer of claim 5, further including a trim tab attachable to said upper bracket.

7. The thrust enhancer of claim 1, wherein said cylindrical ring includes a first part circumferential portion having a first thickness in a fore-aft direction and a second part upper circumferential portion having a second larger thickness in said fore-aft direction.

8. The thrust enhancer of claim 7, wherein said second part circumferential portion is at a top of said cylindrical ring in an arc configuration.

9. The thrust enhancer of claim 7, said mounting means releasably mounting said thrust enhancer on a lower unit propeller protector having a part cylindrical strap, said second part circumferential portion protruding forward of said first part cylindrical portion and entering a space in said strap to combine with said strap to form a cylinder.

10. The thrust enhancer of claim 9, said cylindrical ring and said strap combining to form a cylindrical passageway for water flowing aft of said propeller.

11. A thrust enhancer for a marine propulsion system having a propeller mounted on a shaft having an axis of rotation, said thrust enhancer comprising:

a) a generally cylindrical ring including mounting means for mounting said ring on a marine vessel just aft of said propeller and aligned with said axis of rotation;

b) three to six struts extending radially inwardly within said ring and equally spaced about a circumference of said ring, each strut connected to an exhaust ring concentrically located within said cylindrical ring;

c) each strut having a forward edge bent in a direction opposite to a direction of rotation of said propeller, said direction being counterclockwise, looking in a forward direction from aft of said cylindrical ring; and d) said mounting means including a lower bracket attachable to a skeg of said marine vessel and an upper bracket attachable below a cavitation plate of said marine propulsion system.

12. The thrust enhancer of claim 11, wherein each forward edge of each strut is bent at an angle of about 26° to 36° with respect to a remainder of each respective strut.

13. The thrust enhancer of claim 11, wherein said cylindrical ring includes a first part circumferential portion having a first thickness in a fore-aft direction and a second part circumferential portion having a second larger thickness in said fore-aft direction.

14. The thrust enhancer of claim 13, wherein said second part circumferential portion is at a top of said cylindrical ring, said mounting means releasably mounting said thrust enhancer on a lower unit propeller protector having a part cylindrical strap, said second part circumferential portion protruding forward of said first part circumferential portion and entering a space in said strap to combine with said strap to form a cylinder.

15. The thrust enhancer of claim 14, said cylindrical ring and said strap combining to form a cylindrical passageway for water flowing aft of said propeller.

16. A thrust enhancer for use with a propeller guard attached with a top portion adjacent an outboard engine cavitation plate in a lower drive unit, the thrust enhancer comprising:

a) a generally cylindrical ring including mounting means for mounting the cylindrical ring to the propeller guard and lower unit aft of a propeller mounted on a shaft for the outboard propeller, the cylindrical ring aligned with an axis of rotation of the propeller;

b) three to six struts extending radially inwardly from the cylindrical ring and equally spaced about a circumference of the cylindrical ring, the struts connected to an exhaust ring concentrically located within the cylindrical ring;

c) the struts having a forward edge bent in a direction opposite a direction of rotation of the propeller; and d) the thrust enhancer having a lower mounting bracket connected to a lower portion of the propeller guard.

17. The thrust enhancer of claim 16 wherein the cylindrical ring includes a first part circumferential portion having a first thickness in a fore-aft direction and a second part circumferential segment having a second larger thickness in the fore-aft direction at a top portion of the cylindrical ring.

18. The thrust enhancer of claim 16 wherein there are six struts equally spaced about the cylindrical and exhaust rings and the cylindrical ring diameter is approximately the same as the diameter of the propeller and the exhaust ring is approximately the diameter of the shaft for the outboard propeller.

* * * * *